US006779715B2

(12) United States Patent
Williams

(10) Patent No.: US 6,779,715 B2
(45) Date of Patent: Aug. 24, 2004

(54) COUNTER MECHANISMS

(75) Inventor: Jeffrey B. Williams, Ravenna, OH (US)

(73) Assignee: Lumitex, Inc., Strongsville, OH (US)

( * ) Notice: Subject to any disclaimer, the term of this patent is extended or adjusted under 35 U.S.C. 154(b) by 207 days.

(21) Appl. No.: 10/010,091

(22) Filed: Dec. 6, 2001

(65) Prior Publication Data

US 2003/0106930 A1 Jun. 12, 2003

(51) Int. Cl.[7] ..... G06C 15/42
(52) U.S. Cl. ..... 235/144 D; 235/103
(58) Field of Search ..... 235/144 D, 103, 235/104, 1 B, 1 C; 128/200.11, 200.12, 200.14

(56) References Cited

U.S. PATENT DOCUMENTS 5,564,414 A * 10/1996 Walker et al. ..... 128/200.23
5,569,190 A * 10/1996 D'Antonio ..... 604/72
5,988,893 A * 11/1999 Schroder et al. ..... 396/411

* cited by examiner

*Primary Examiner*—Karl D. Frech
(74) *Attorney, Agent, or Firm*—Renner, Otto, Boisselle & Sklar, LLP

(57) ABSTRACT

Counter mechanisms for measuring the useful life of a reposable or disposable device include an actuator that drives a counter each time the device is used, sterilized and/or two or more parts of the device are fitted together. A display may be provided to display the number of times the counter is driven. A signaling device may also be provided that is responsive to the device having been used a specified number of times (based on the actual number of uses, sterilizations and/or fitting of two or more parts together) to provide an indication of when the device should no longer be used. Further, a disabling mechanism may be provided to prevent further use of the device after the specified number of uses.

66 Claims, 6 Drawing Sheets

COUNTER MECHANISMS

FIELD OF THE INVENTION

This invention relates to counter mechanisms for determining the number of times a reposable or disposable device has been used or reprocessed, and indicating when the device may no longer be safe or effective to use.

BACKGROUND OF THE INVENTION

Various devices used for example in medical or other applications may be limited in the number of times they can safely or effectively be used with sterilization between uses. As used herein, the term sterilization encompasses one or more of the following: sterilizing, disinfecting and cleaning. Such devices may generally degrade somewhat with each use (and subsequent sterilization) until they become unsafe or ineffective to use further. A manufacturer may validate the useful life of such devices, which should provide some margin of safety taking into account variations of the entire population.

There is thus a need to provide some means for effectively determining the number of uses of a reposable or disposable device, and indicating when the device may no longer be effective or safe to use.

SUMMARY OF THE INVENTION

The counter mechanisms of the present invention may be used to determine the number of uses of a reposable or disposable device based on one or more parameters, and may also provide an indication of when the device should no longer be used. A reposable device is one that is reusable for a limited number of times with, for example, as in the case of a medical type device, sterilization between uses.

In accordance with one aspect of the invention, the counter mechanism may be driven by an actuator that may be mechanically actuated or be an electrical or optical switch or sensor.

In accordance with another aspect of the invention, the actuator may be driven by an operator manually activating the actuator upon each use.

In accordance with another aspect of the invention, the actuator may be driven by the mechanical action of assembling mating parts of the device upon each use.

In accordance with another aspect of the invention, the actuator may be activated by electrical or mechanical sensors when specific values of one or more environmental factors are reached during sterilization of the device.

In accordance with another aspect of the invention, means may be provided for measuring for different environmental factors or parameters used to sterilize a device to determine the useful life of the device.

In accordance with another aspect of the invention, mechanical or electrical means may be provided for counting the number of actuations of the actuator.

In accordance with another aspect of the invention, the actuator may drive or move a display.

In accordance with another aspect of the invention, the display may display the number of uses of the device, or count down the number of uses left of the device.

In accordance with another aspect of the invention, the display may be graphic, or may include movable flags or pins or lights which may flash or blink to indicate or draw attention to when the device has been used a specified number of times.

In accordance with another aspect of the invention, the display may be an electronic or mechanical display.

In accordance with another aspect of the invention, the counter mechanism may include means to prevent further use of the device after a specified number of uses or cycles, for example, by interrupting electrical connections, blocking light, obstructing fluid paths, preventing assembly of components or connectors, and/or disabling mechanical linkages.

In accordance with another aspect of the invention, the counter mechanism may be incorporated into the device, or be a stand alone mechanism which attaches to or is associated with the device.

In accordance with another aspect of the invention, the counter mechanism may contain its own power supply to power electrical displays or counters.

In accordance with another aspect of the invention, the counter mechanism may include a recorder for recording specific values or parameters that one or more environmental factors attained and/or the length of time one or more environmental factors or parameters were maintained during sterilization of the device to validate that a sterilization cycle has been successfully completed.

In accordance with another aspect of the invention, a timer may be used to measure the total time a device is used or the different settings or parameters at which a device is operated, or the length of time the device is used above some specified parameter, to measure the useful life of the device.

In accordance with another aspect of the invention, the counter mechanism may be reset after a device has been refurbished or replaced to permit the counter mechanism to be put back into use to measure the useful life of the same or a different device.

In accordance with another aspect of the invention, the counter mechanism may communicate with other equipment, either to download information for permanent storage, or to receive information from another piece of equipment.

Still other aspects and/or advantages of the present invention will become apparent to those skilled in the art upon the reading and understanding of the following detailed description, accompanying drawings and appended claims. The following description and annexed drawings set forth in detail certain illustrative embodiments of the invention, these being indicative, however, of but several of the various ways in which the principles of the invention may be employed.

DETAILED DESCRIPTION OF THE INVENTION

Figure 1:
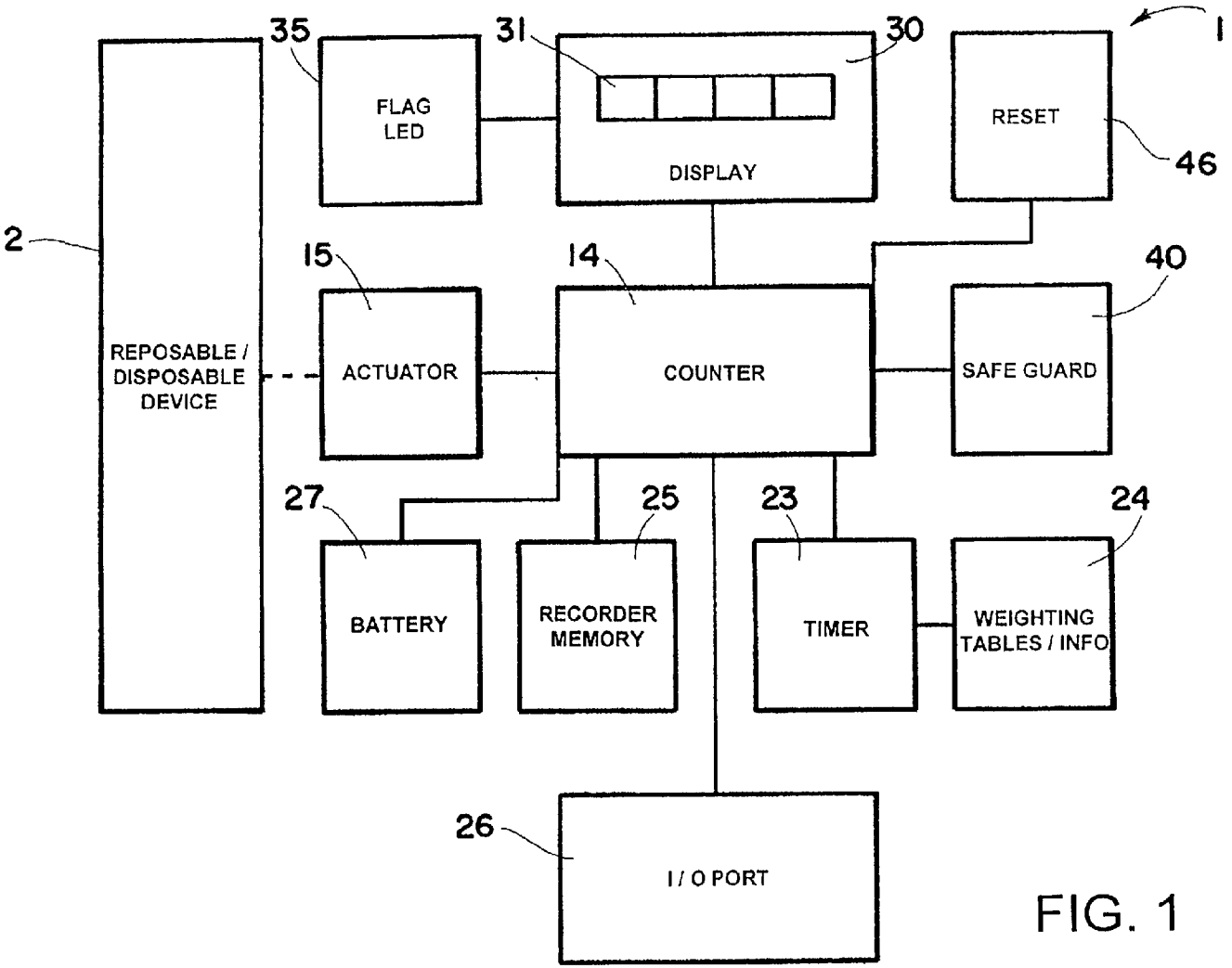
FIG. 1 is a block diagram of a counter mechanism in accordance with the present invention shown operatively connected to an associated device.

Referring now in detail to the drawings wherein the showings are for purposes of illustrating several embodiments of the invention only and not for purposes of limiting same, FIG. 1 is a block diagram of a counter mechanism 1 in accordance with the present invention for determining the number of uses of a reposable or disposable device 2 that is reusable for a limited number of times with, for example, sterilization between uses. As previously indicated, the term sterilization as used herein encompasses any one or more of sterilizing, disinfecting and cleaning. Counter mechanism 1 may also display and/or record the number of uses and provide an indication or signal of when the device is no longer safe or effective to use. Further, counter mechanism 1 may prevent further use of the device after its useful life has been attained.

Figure 2:
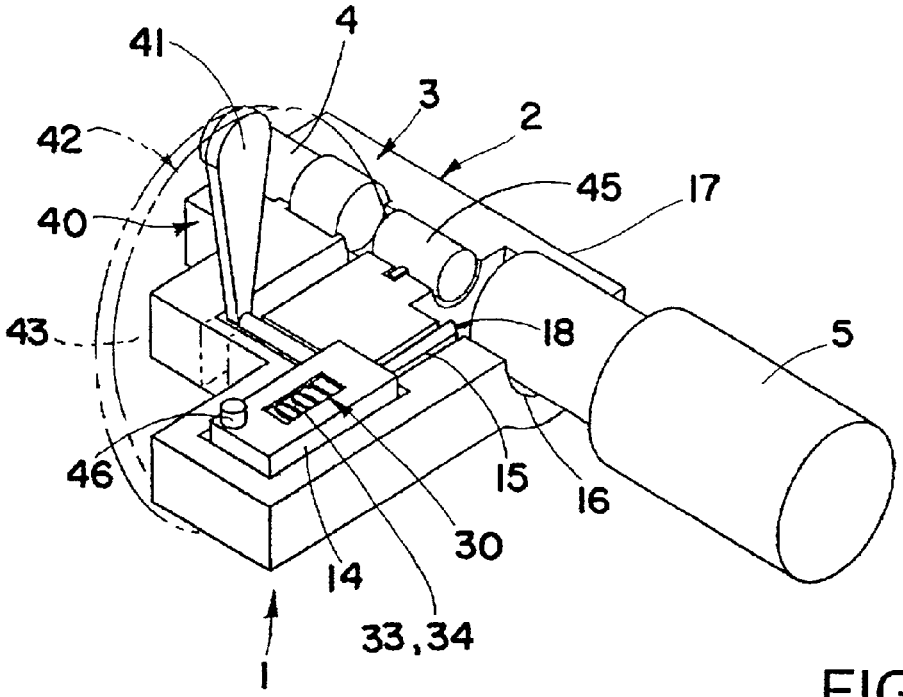
FIGS. 2 and 3 are fragmatic perspective views of one form of counter mechanism of the present invention that is integral with an associated device having two or more parts that are intended to be fitted together prior to each use.
Figure 3:
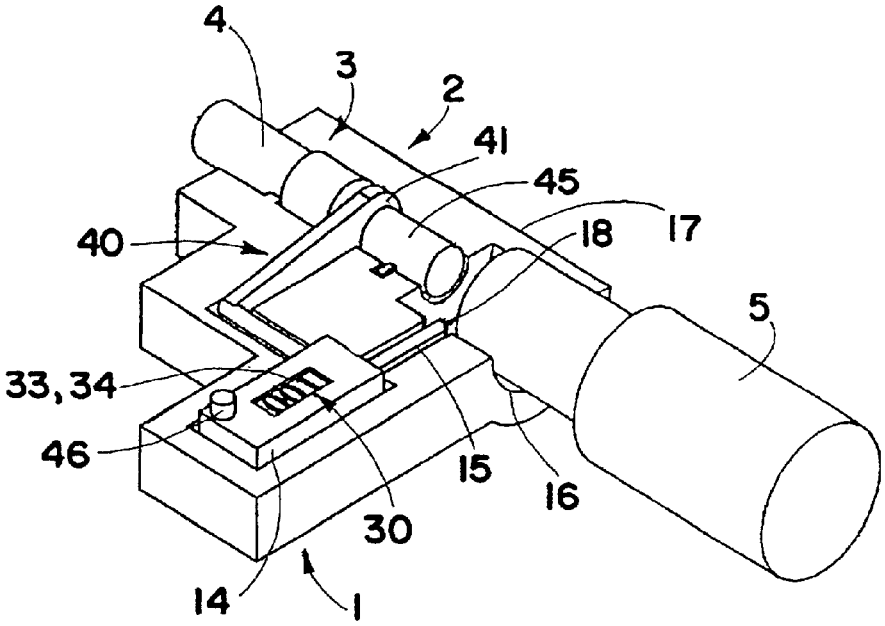
Figure 4:
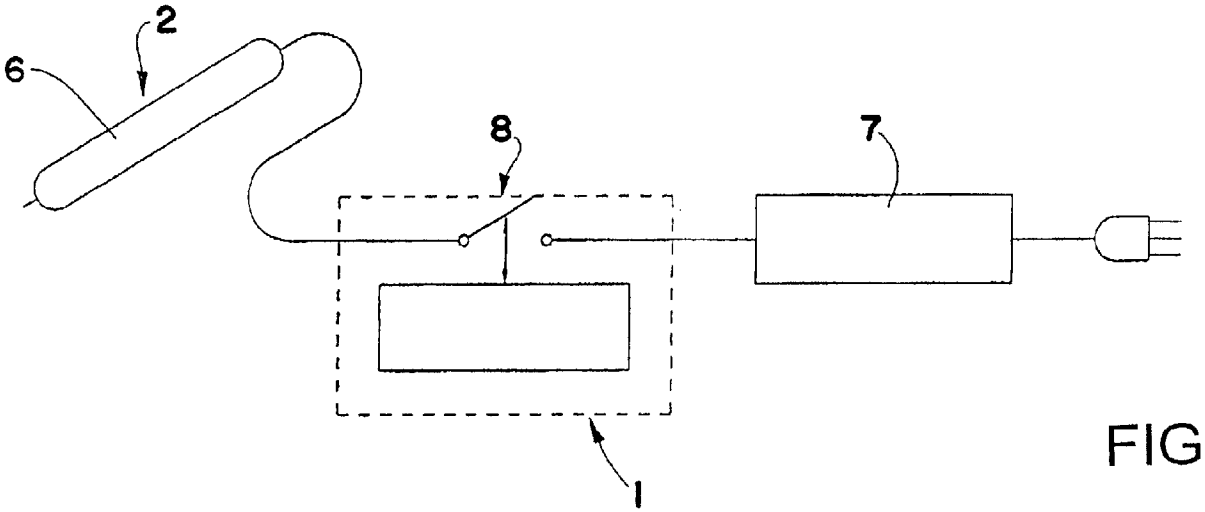
FIGS. 4 and 5 are schematic illustrations of two other forms of counter mechanisms of the present invention associated with other devices.
Figure 5:
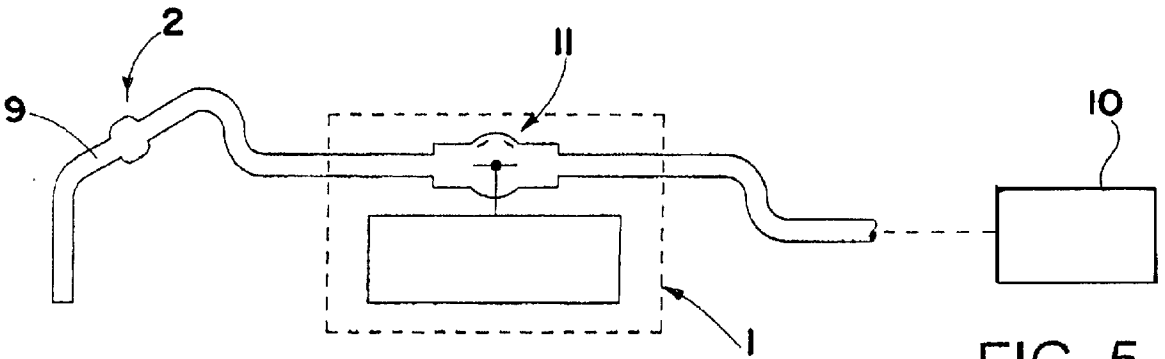

The device 2 may, for example, be a lighting device or a functional instrument or comprise a structural member or portion of a lighting device or functional instrument. FIGS. 2 and 3 show a lighting device 3 including a light distributor 4 and a connecting light source cable or conduit 5 for supplying light to the light distributor from a remote light source (not shown). FIG. 4 shows a cauterizing device 6 powered by an electrical power supply 7 through a switch 8. FIG. 5 shows a device 9 which may comprise a suction device, an evacuation tube, an irrigation tube or a blower device connected to a suitable vacuum or fluid supply 10 through a valve 11. Of course, it should be appreciated that the device 2 (including devices 3, 6 and 9) may take many other forms as well, including, for example, an electrosurgical pencil, a retractor, a stabilizer, a tongue depressor, a swab, a forceps, a dental instrument, and a transillumination tray, to name a few.

Referring further to FIG. 1, counter mechanism 1 includes a counter 14 driven by an actuator 15 that may be mechanically actuated or be an electrical or optical switch or sensor that is actuated in response to some event relating to the use of the device or sterilization of the device between uses as described hereafter.

FIGS. 2 and 3 show in greater detail one form of counter mechanism 1 in accordance with this invention associated with device 3 which has its connecting light source cable or conduit 5 fitted within a socket 16 in the device housing 17. After each use, it is intended that one of the parts (in this case the connecting light source cable or conduit 5) be disconnected from another part (in this case the light distributor 4) to permit one or more of the parts to be sterilized between uses. Before the device 3 can be used again, the connecting light source cable or conduit 5 must be reinserted into the socket 16. During each insertion, a portion of the conduit 5 engages a cam surface 18 on the inner end of the actuator 15 of counter mechanism 1 causing the actuator to be mechanically displaced to drive the associated counter 14.

In other forms of the invention disclosed herein, the actuator 15 may include a sensor that is responsive to one or more environmental factors of an environment in which the device is sterilized reaching specified values validating that the device has been sterilized. The environmental factors may comprise for example one or more of the following: temperature, pressure, vacuum, gas or chemical concentration, radiation, light, and humidity.

Figure 6:
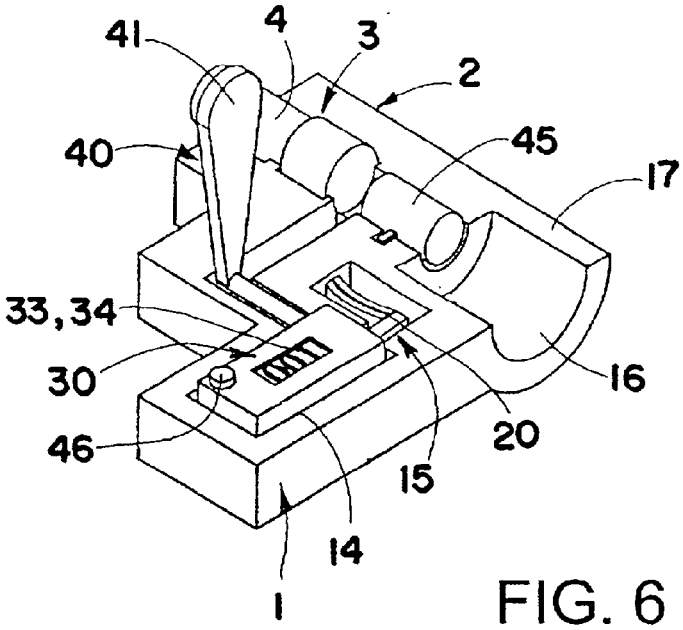
FIGS. 6 and 7 are fragmatic perspective views of another form of counter mechanism of the present invention that is integral with an associated device.
Figure 7:
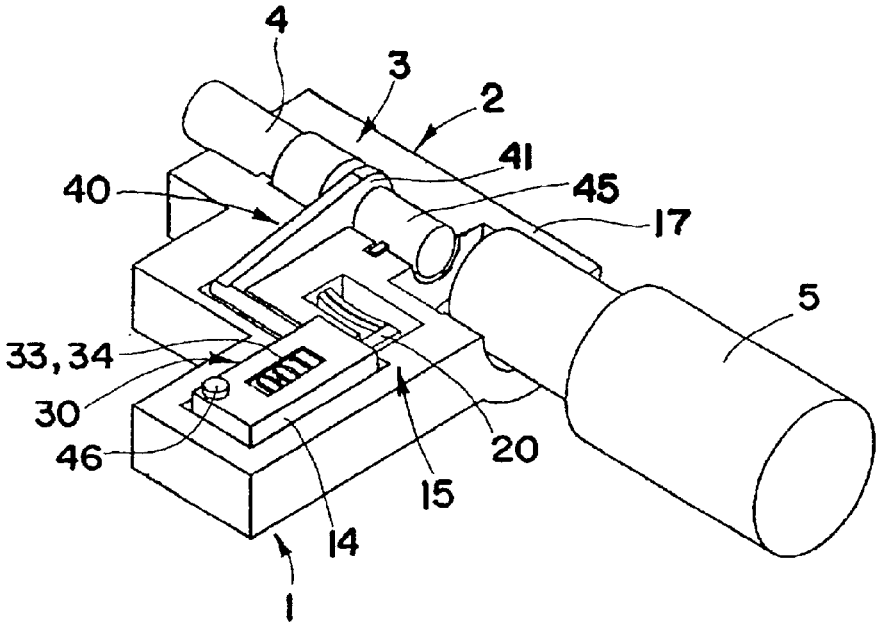
Figure 8:
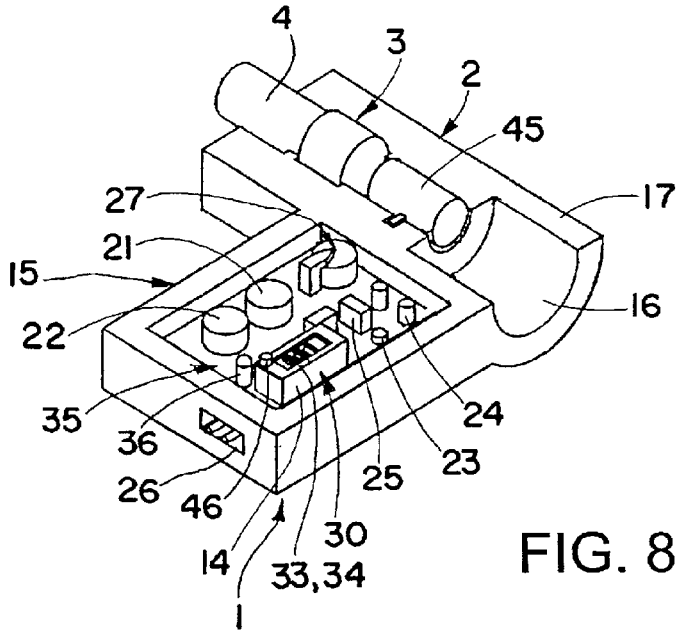
FIG. 8 is a fragmatic perspective view of another form of counter mechanism of the present invention that is integral with an associated device.

FIGS. 6 and 7 show one such actuator 15 including a bimetallic metal strip sensor 20 that drives the counter 14 in response to the temperature within a sterilizing environment (e.g., an autoclave, not shown) in which the device is placed reaching a specified value validating that the device has been sterilized, whereas FIG. 8 shows another actuator 15 including a sensor 21 for sensing such other environmental factors of the sterilizing environment as gas or chemical concentration, gamma radiation, light and/or humidity.

Referring further to FIG. 8, actuator 15 may also include a pressure transducer 22 for measuring the pressure or vacuum within the sterilizing environment. For example, if a sterilizing gas such as ethylene oxide (EtO) is used to sterilize the device, pressure transducer 22 may be used to verify that the air has been evacuated from the sterilizing environment before the sterilizing gas is introduced into the sterilizing environment. Further, if desired the pressure transducer 22 may be used to determine when the sterilizing gas within the sterilizing environment reaches a predetermined pressure above atmospheric pressure to accelerate the sterilizing process.

In some cases the device 2 may be sterilized by multiple methods each having a different effect on the useful life of the device. For example, a device which is generally steam sterilized might possibly be sterilized at different temperatures/pressures for different periods of time (e.g., a standard setting at a specified temperature/pressure for example for 15 minutes or a "flash" setting at a higher temperature/pressure for example for 3 minutes which accelerates the sterilizing process but wears the device out faster). In that event, sensor 21 may measure different environmental factors and parameters to determine the sterilizing method used and its effect on the useful life of the device.

Moreover, the device 2 may be of a type that is operable at different settings or parameters that have different effects on the useful life of the device. For example, the device may be a cauterizing device that has a longer useful life when run at lower current than at higher current. In that event the actuator 15 may include a timer 23 for measuring the total time that the device is used at each different setting or parameter, and a controller 24 for determining the useful life of the device based on such measurements.

In addition, the counter mechanism 1 may include a recorder 25 for recording a specified value the environmental factor attained and/or the setting or parameters and/or the length of time the factor, setting and/or parameters were maintained during sterilization of the device. Also, the counter mechanism 1 may be provided with a port 26 to permit the counter mechanism to communicate with other equipment, to download information for permanent storage and/or to receive information from other equipment, as desired. Further, if the counter mechanism 1 is electrically powered, the counter mechanism may include a battery 27 as schematically shown in FIGS. 1 and 8 to provide its own electrical power supply.

Figure 9:
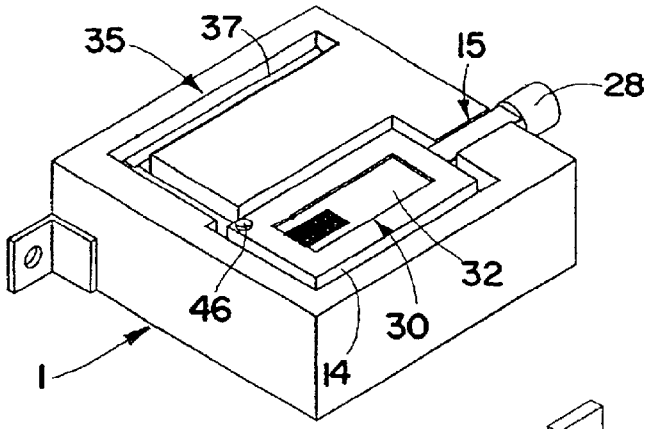
FIGS. 9 and 10 and FIGS. 11 and 12 are respective perspective views of two other forms of counter mechanisms of the present invention that are removably attachable to an associated device.
Figure 10:
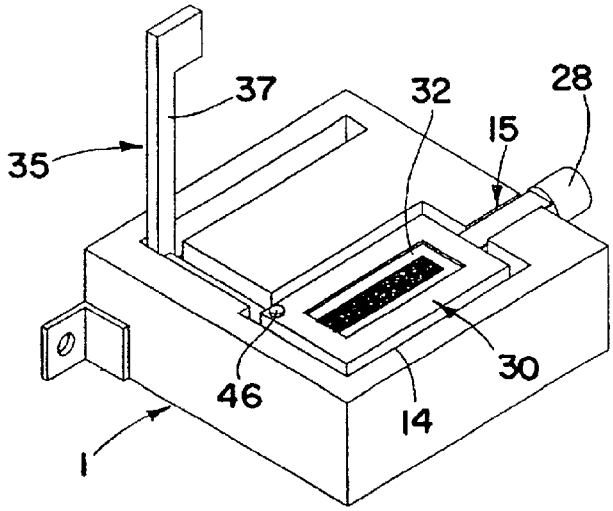

In another embodiment of the invention shown in FIGS. 9 and 10, the actuator 15 may be manually driven by the operator depressing or rotating a push button or knob 28 to drive the counter 14 upon each use and/or intended use of the device.

Regardless of the type of actuator 15 used, the counter mechanism 1 may include a display 30 for displaying the number of times the device has been used or sterilized and/or the number of times two or more parts of the device have been fitted together. Alternatively, the display 30 may display the number of uses remaining of the device based on the number of uses, sterilizations, fittings, etc. of the device. In any case the display 30 may be mechanical such as rotary numbered wheels 31 as schematically shown in FIG. 1 or a moving bar graph 32 as schematically shown in FIGS. 9 and 10. Alternatively, the display 30 may be electronic in nature including for example a liquid crystal display (LCD) 33 or a light emitting diode display (LED) 34 as schematically shown for example in FIGS. 2 and 3.

Counter mechanism 1 may also include some type of signaling device 35 that is responsive to the device having been used a specified number of times (based for example on the actual number of uses, sterilizations and/or fittings of two or more parts of the device together) to provide an indication of when the device should no longer be used. FIG. 8 shows one such signaling device 35 in the form of a light 36 that is activated whenever the device 2 has been used a specified number of times to call attention to the number of times. The light 36 may simply be turned on or caused to blink or flash when the device has been used a specified number of times.

Figure 11:
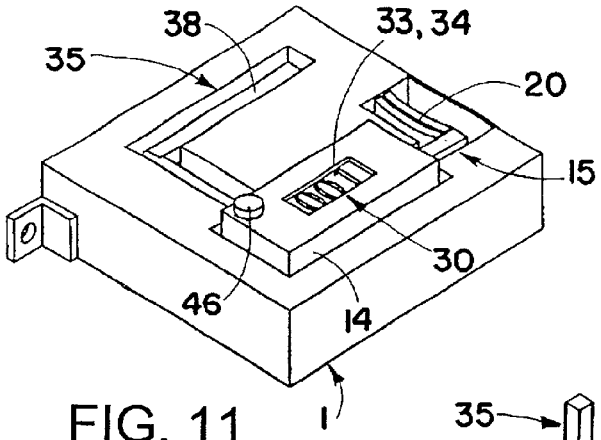
Figure 12:
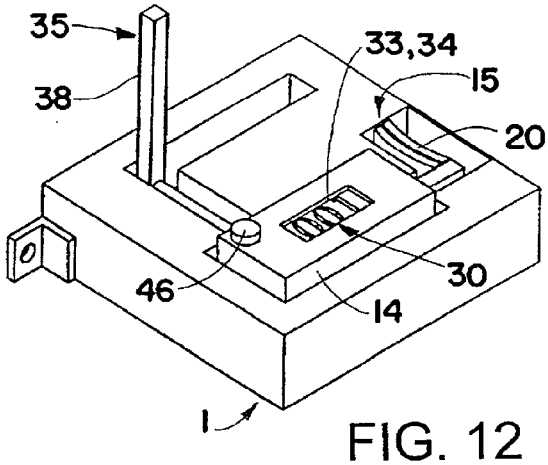

FIGS. 9–12 show other signaling devices 35 in the form of a flag 37 or pin 38, respectively, that is moved from a "down" or non-prominent position as shown in FIGS. 9 and 11 to an "up" or prominent position shown in FIGS. 10 and 12 when the device has been used a specified number of times to call attention to the number of uses.

Counter mechanism 1 may either be incorporated directly into the device 2 as schematically shown in FIGS. 2, 3, 6–8, 13 and 14 or be a stand alone counter mechanism as schematically shown in FIGS. 9–12 which attaches to or is associated with the device. Also, counter mechanism 1 may include a disabling mechanism 40 to prevent further use of the device 2 after a specified number of uses or cycles, for example, by blocking light, preventing assembly of components or connectors and/or disabling mechanical linkages, or by interrupting electrical connections or obstructing fluid paths. FIGS. 2, 3, 6 and 7, for example, show a safeguard mechanism 40 in the form of a shutter 41 that is moved (e.g., rotated) from the passive non-light blocking position shown in FIGS. 2 and 6 to the active light blocking position shown in FIGS. 3 and 7 blocking the light path between the connecting light source cable or conduit 5 and the light distributor 4 of the lighting device 3 after the specified number of uses. If desired, the shutter 41 may comprise a rotary vane 42 (shown in phantom lines in FIG. 2) including a light blocking portion 41 that moves into position blocking the light path to the device after the rotary vane has been indexed a specified number of times corresponding to the specified number of uses of the device. The non-light blocking portion 43 of the rotary vane 42 may be made of different materials that selectively filter out certain frequencies of light (for example InfraRed), allowing only those light frequencies desired to pass into the light distributor 4. Also, a light guide 45 may be mounted between the light distributor 4 and conduit socket 16 and may be made out of different materials to filter out undesired frequencies of light. Also, light guide 45 may be made of materials that can withstand higher temperatures than the light distributor 4, thus eliminating the need to construct the lighting device 3 with extensive heat sinking to remove excess heat.

In the embodiment shown in FIG. 4, the switch 8 is actuated by the counter mechanism 1 after the device 2 has been used a specified number of times to interrupt an electrical connection to the device which in the example shown is a cauterizing device 6. In the embodiment shown in FIG. 5, the valve 11 is actuated by the counter mechanism 1 after the specified number of uses of the device 2 to interrupt a suction or fluid flow to the device, which may for example be a suction device, a blower device or an irrigation device 9.

Figure 13:
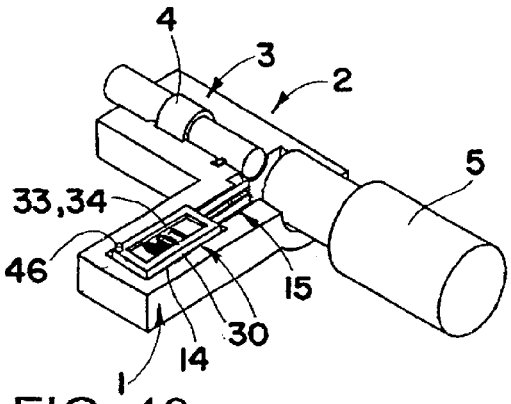
FIGS. 13 and 14 are perspective views of another form of counter mechanism of the present invention that is integral with an associated device.
Figure 14:
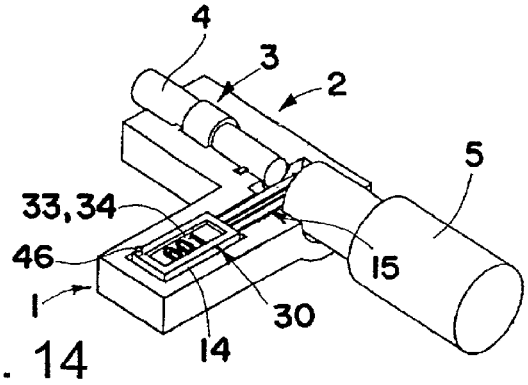

In another embodiment of the invention shown in FIGS. 13 and 14, the disabling mechanism 40 is part of the actuator 15 which is normally mechanically displaced out of the way during fitting of two parts of the device 4 together as schematically shown in FIG. 13. However, after the parts 4, 5 have been fitted together a specified number of times, the actuator 15 of the FIGS. 13 and 14 embodiment is mechanically locked in the fully extended position shown in FIG. 14 preventing further assembly of the parts.

After the device 2 has been used the specified number of times, the counter mechanism 1 may be reset as by activating a reset button 46, schematically shown in several of the figures, to permit the counter mechanism to be put back into use to measure the useful life of another device that has been refurbished or replaced as desired.

Although the invention has been shown and described with respect to certain embodiments, it is obvious that equivalent alterations and modifications will occur to others skilled in the art upon the reading and understanding of the specification. In particular, with regard to the various functions performed by the above described components, the terms (including any reference to a "means") used to describe such components are intended to correspond, unless otherwise indicated, to any component which performs the specified function of the described component (e.g., that is functionally equivalent), even though not structurally equivalent to the disclosed component which performs the function in the herein illustrated exemplary embodiments of the invention. In addition, while a particular feature of the invention may have been disclosed with respect to only one embodiment, such feature may be combined with one or more other features of other embodiments as may be desired or advantageous for any given or particular application.

What is claimed is:

1. A mechanism for measuring the useful life of a reposable or disposable device having at least two parts that are intended to be fitted together prior to each use of the device comprising a counter, and an actuator for driving the counter in response to each fitting of the parts together in order to permit use of the device.

2. The mechanism of claim 1 wherein the actuator is driven by the mechanical action of fitting the parts together.

3. The mechanism of claim 2 wherein the actuator has a cam surface that is engaged by one of the parts during fitting of the parts together to drive the actuator.

4. The mechanism of claim 1 wherein the actuator comprises a switch that is activated in response to the fitting of the parts together in order to permit use of the device.

5. The mechanism of claim 4 wherein the switch comprises an electrical switch.

6. The mechanism of claim 4 wherein the switch comprises an optical switch.

7. The mechanism of claim 1 further comprising means for manually driving the actuator whenever the parts are fitted together.

8. The mechanism of claim 7 wherein the means for manually driving the actuator comprises at least one of: a push button and a rotating knob.

9. The mechanism of claim 1 wherein the counter includes a display.

10. The mechanism of claim 9 wherein the display displays the number of times the device has been used based on the number of times the parts are fitted together.

11. The mechanism of claim 9 wherein the display counts down the number of uses remaining of the device based on the number of times the parts are fitted together.

12. The mechanism of claim 9 wherein the display includes a graphic display.

13. The mechanism of claim 9 wherein the display is an electronic display.

14. The mechanism of claim 13 wherein the electronic display comprises at least one of: an LCD display and an LED display.

15. The mechanism of claim 9 wherein the display is a mechanical display.

16. The mechanism of claim 15 wherein the mechanical display comprises at least one of: oratory numbered wheels and a moving bar graph.

17. The mechanism of claim 1 further comprising signaling means responsive to the device having been used a specified number of times based on the number of times the parts are fitted together to draw attention to the number of uses.

18. The mechanism of claim 17 wherein the signaling means comprises a flag that is caused to move from a lowered non-prominent position to a raised prominent position when the device has been used a specified number of times to call attention to the number of uses.

19. The mechanism of claim 17 wherein the signaling means comprises a pin that is caused to move from a lowered non-prominent position to a raised prominent position when the device has been used a specified number of times to call attention to the number of uses.

20. The mechanism of claim 17 wherein the signaling means comprises a light that is activated when the device has been used a specified number of times to call attention to the number of uses.

21. The mechanism of claim 20 wherein the light is caused to blink or flash when the device has been used a specified number of times.

22. The mechanism of claim 1 further comprising means for preventing use of the device after a specified number of uses based on the number of times the parts are fitted together.

23. The mechanism of claim 22 wherein the means for preventing comprises a switch for interrupting an electrical connection to the device after the specified number of uses.

24. The mechanism of claim 22 wherein the means for preventing comprises a valve for blocking a fluid path to the device after the specified number of uses.

25. The mechanism of claim 22 wherein the means for preventing comprises a mechanical element that prevents the parts from being fitted together after the specified number of uses.

26. The mechanism of claim 25 wherein the mechanical element extends into the path of the parts preventing the parts from being fitted together after the specified number of uses.

27. The mechanism of claim 26 further comprising means for causing the mechanical element to move out of the path of the parts to permit the parts to be fitted together up to the specified number of uses.

28. The mechanism of claim 1 which comprises an integral part of the device.

29. The mechanism of claim 1 which is removably attached to the device.

30. The mechanism of claim 1 further comprising means for resetting the counter after counting a specified number of uses based on the number of times the parts are fitted together.

31. The mechanism of claim 1 which is electrically powered, and the mechanism includes its own electrical power supply to power the mechanism.

32. A mechanism for measuring the useful life of a reposable or disposable device having at least two parts that are intended to be fitted together prior to each use of the device comprising a counter, an actuator for driving the counter in response to each fitting of the parts together, and means for preventing use of the device after a specified number of uses based on the number of times the parts are fitted together, the means for preventing comprising a shutter for blocking a light path to the device after the specified number of uses.

33. The mechanism of claim 32 wherein the shutter is mounted for pivotal movement into the light path.

34. The mechanism of claim 32 wherein the shutter comprises a rotary vane that is indexed by the actuator each time the counter is driven, the rotary vane having a light blocking portion that blocks the light path to the device after the rotary vane has been indexed a specified number of times corresponding to the specified number of uses of the device.

35. A mechanism for measuring the useful life of a reposable or disposable device having at least two parts that are intended to be fitted together prior to each use of the device comprising a counter, an actuator for driving the counter in response to each fitting of the parts together, and communication means for providing communication between the counter and other equipment.

36. The mechanism of claim 35 wherein the communication means downloads information from the counter to the other equipment.

37. The mechanism of claim 35 wherein the communication means receives information from the other equipment.

38. A mechanism for measuring the useful life of a reposable or disposable device that is intended to be sterilized in a sterilizing environment before each use comprising a counter, and an actuator for driving the counter in response to at least one environmental factor of the sterilizing environment in which the device is sterilized reaching a specified value validating that the device has been sterilized.

39. The mechanism of claim 38 further comprising means for measuring different environmental factors and parameters used to sterilize the device to determine the useful life of the device.

40. The mechanism of claim 38 wherein the environmental factor comprises at least one of the following: temperature, pressure, vacuum, gas or chemical concentration, radiation, light, and humidity.

41. The mechanism of claim 38 wherein the device is subjected to a plurality of environmental factors in the sterilizing environment, and the actuator is responsive to a combination of the environmental factors reaching specified values validating that the device has been sterilized.

42. The mechanism of claim 41 wherein the combination of environmental factors comprises at least two of the following: temperature, pressure, vacuum, gas or chemical concentration, radiation, light, and humidity.

43. The mechanism of claim 38 further comprising a recorder for recording at least one of: the specified value that the environmental factor attained and the length of time that the environmental factor was maintained during sterilization of the device.

44. The mechanism of claim 38 wherein the environmental factor is temperature, and the actuator comprises a bimetal strip that drives the counter whenever the temperature cycles above a specified value during sterilization of the device.

45. The mechanism of claim 38 wherein the environmental factor is a sterilizing chemical, and the actuator comprises a sensor that drives the counter when a concentration of the sterilizing chemical cycles above a specified value during sterilization of the device.

46. The mechanism of claim 38 wherein the environmental factor is humidity, and the actuator comprises a sensor that drives the counter when the humidity cycles above a specified value during sterilization of the device.

47. The mechanism of claim 38 wherein the environmental factor is radiation, and the actuator comprises a sensor that drives the counter when the radiation cycles above a specified value during sterilization of the device.

48. The mechanism of claim 38 wherein the counter includes a display that displays the number of times the device has been used based on the number of sterilizations of the device.

49. The mechanism of claim 38 wherein the counter includes a display that counts down the number of uses remaining of the device based on the number of sterilizations of the device.

50. The mechanism of claim 38 further comprising signaling means responsive to the device having been used a specified number of times based on the number of sterilizations of the device to draw attention to the number of uses.

51. The mechanism of claim 50 wherein the signaling means comprises a flag that is caused to move to a prominent position when the device has been used a specified number of times based on the number of sterilizations of the device.

52. The mechanism of claim 50 wherein the signaling means comprises a pin that is caused to move to a prominent position when the device has been used a specified number of times based on the number of sterilizations of the device.

53. The mechanism of claim 50 wherein the signaling means comprises a light that is activated when the device has been used a specified number of times based on the number of sterilizations of the device.

54. The mechanism of claim 38 further comprising means for preventing use of the device after a specified number of uses based on the number of sterilizations of the device.

55. A mechanism for measuring the useful life of a reposable or disposable device that is operable at a plurality of settings that have different effects on the useful life of the device comprising a timer for measuring the total time that the device is operated at each of the settings, and means for determining the useful life of the device based on such measurements.

56. The mechanism of claim 55 further comprising a recorder for recording the settings at which the device is operated and time measured.

57. The mechanism of claim 55 further comprising means for disabling the device after the useful life is reached based on such measurements.

58. The mechanism of claim 55 further comprising a display for displaying the remaining useful life of the device based on such measurements.

59. The mechanism of claim 55 further comprising signaling means for signaling when the device reaches its useful life based on such measurements.

60. A mechanism for measuring the useful life of a reposable or disposable device comprising a counter for counting each time the device is used, and signaling means for signaling when the device has been used a specified number of times, the signaling means comprising a flag that is caused to move from a lowered non-prominent position to a raised prominent position when the device has been used the specified number of times.

61. A mechanism for measuring the useful life of a reposable or disposable device comprising a counter for counting each time the device is used, and signaling means for signaling when the device has been used a specified number of times, the signaling means comprising a pin that is moved from a lowered non-prominent position to a raised prominent position when the device has been used the specified number of times.

62. A mechanism for measuring the useful life of a reposable or disposable device comprising a counter for counting each time the device is used, signaling means for signaling when the device has been used a specified number of times, and means for preventing use of the device after the specified number of uses.

63. The mechanism of claim 62 wherein the means for preventing comprises a shutter for blocking a light path to the device after the specified number of uses.

64. The mechanism of claim 62 wherein the means for preventing comprises a switch for interrupting an electrical connection to the device after the specified number of uses.

65. The mechanism of claim 62 wherein the means for preventing comprises a valve for blocking a fluid path to the device after the specified number of uses.

66. The mechanism of claim 62 wherein the means for preventing comprises a mechanical linkage that is disabled after the specified number of uses.

* * * * *